US007728574B2

(12) United States Patent
Kalyanaraman

(10) Patent No.: US 7,728,574 B2
(45) Date of Patent: Jun. 1, 2010

(54) REFERENCE CIRCUIT WITH START-UP CONTROL, GENERATOR, DEVICE, SYSTEM AND METHOD INCLUDING SAME

(75) Inventor: Vignesh Kalyanaraman, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 521 days.

(21) Appl. No.: 11/356,910

(22) Filed: Feb. 17, 2006

(65) Prior Publication Data

US 2007/0194770 A1 Aug. 23, 2007

(51) Int. Cl.
*G05F 3/16* (2006.01)
*G05F 3/20* (2006.01)

(52) U.S. Cl. ..... 323/313; 323/901; 363/49

(58) Field of Classification Search ..... 323/313, 323/901, 238, 321
See application file for complete search history.

(56) References Cited

U.S. PATENT DOCUMENTS 4,593,208 A 6/1986 Single
4,742,281 A * 5/1988 Nakano et al. ..... 388/815
4,849,684 A * 7/1989 Sonntag et al. ..... 323/313
4,857,823 A * 8/1989 Bitting ..... 323/314
4,906,863 A 3/1990 Van Tran
4,931,718 A * 6/1990 Zitta ..... 323/313
5,214,320 A * 5/1993 Truong ..... 326/33
5,315,231 A 5/1994 Linder et al.
5,367,249 A * 11/1994 Honnigford ..... 323/313
5,565,811 A * 10/1996 Park et al. ..... 327/546
5,610,506 A 3/1997 McIntyre
5,840,612 A 11/1998 Oki et al.
5,949,227 A * 9/1999 Bujanos ..... 323/313
6,002,245 A 12/1999 Sauer
6,133,719 A * 10/2000 Maulik ..... 323/313
6,150,872 A 11/2000 McNeill et al.
6,160,392 A * 12/2000 Shin ..... 323/313
6,181,122 B1 * 1/2001 Larsen et al. ..... 323/313
6,191,644 B1 2/2001 Srinath et al.
6,201,435 B1 * 3/2001 Chou ..... 327/543
6,242,898 B1 * 6/2001 Shimizu et al. ..... 323/313
6,278,320 B1 8/2001 Vu
6,400,207 B1 * 6/2002 Ivanov et al. ..... 327/374
6,507,179 B1 1/2003 Jun et al.
6,529,066 B1 3/2003 Guenot et al.
6,566,850 B2 5/2003 Heinrich
6,642,778 B2 11/2003 Opris
6,677,808 B1 1/2004 Sean et al.
6,686,797 B1 2/2004 Eker
6,707,286 B1 3/2004 Gregoire, Jr.

(Continued)

*Primary Examiner*—Edward Tso
*Assistant Examiner*—Arun Williams
(74) *Attorney, Agent, or Firm*—TraskBritt

(57) ABSTRACT

A reference generator circuit generates a reference signal for use by a regulator in generating operational power for circuits and devices. A start-up circuit includes a self-biased voltage reference and a differential amplifier configured to generate a start-up signal to induce current flow in response to the voltage independent reference during the start-up phase of the circuit and cease inducing the current flow following the start-up phase of the circuit. The reference signal is generated by receiving a supply voltage and inducing current flow into a node of a bandgap reference circuit during a start-up phase of the bandgap reference circuit and ceasing inducing the current flow following the start-up phase of the bandgap reference circuit.

16 Claims, 5 Drawing Sheets

U.S. PATENT DOCUMENTS

| | | | | |
|---|---|---|---|---|
| 6,727,744 | B2 | 4/2004 | Nagaya | |
| 6,727,745 | B2 | 4/2004 | Shearon et al. | |
| 6,771,055 | B1 | 8/2004 | Bell | |
| 6,774,711 | B2 | 8/2004 | Bernard | |
| 6,841,982 | B2 | 1/2005 | Tran | |
| 6,853,164 | B1 | 2/2005 | Prinz et al. | |
| 6,856,189 | B2 | 2/2005 | Somerville | |
| 6,885,178 | B2 | 4/2005 | Marinca | |
| 6,894,555 | B2 | 5/2005 | Liu | |
| 6,900,689 | B2 * | 5/2005 | Kimura | 327/542 |
| 6,933,769 | B2 * | 8/2005 | Koelling | 327/538 |
| 6,933,770 | B1 | 8/2005 | Ranucci | |
| 6,943,617 | B2 | 9/2005 | Tran et al. | |
| 7,098,729 | B2 * | 8/2006 | Abe | 327/539 |
| 7,256,643 | B2 * | 8/2007 | Pan et al. | 327/539 |
| 2001/0043486 | A1 * | 11/2001 | Naffziger et al. | 365/154 |
| 2003/0020536 | A1 * | 1/2003 | Hisano | 327/538 |
| 2004/0046538 | A1 * | 3/2004 | Sivero et al. | 323/315 |
| 2004/0150381 | A1 * | 8/2004 | Butler | 323/313 |
| 2004/0245975 | A1 | 12/2004 | Tran et al. | |
| 2004/0257853 | A1 * | 12/2004 | Salling et al. | 365/145 |
| 2004/0264255 | A1 * | 12/2004 | Royer | 365/189.01 |
| 2005/0231270 | A1 * | 10/2005 | Washburn | 327/539 |
| 2006/0091873 | A1 * | 5/2006 | Srinivasan | 323/313 |
| 2007/0132505 | A1 * | 6/2007 | Kinoshita et al. | 327/539 |

* cited by examiner

REFERENCE CIRCUIT WITH START-UP CONTROL, GENERATOR, DEVICE, SYSTEM AND METHOD INCLUDING SAME

BACKGROUND OF THE INVENTION

1. Field of the Invention

The present invention relates generally to reference circuits and, in particular, to bandgap reference circuits that provide reference signals of substantially constant voltage levels.

2. State of the Art

Many electrical devices have a reference circuit for generating a reference signal for internal use that is based or derived from an external source. The external source is often a supply voltage with the generated reference signal being representative of either a reference current or a reference voltage. The reference circuit is usually designed such that the reference signal maintains a constant level over variations in the supply voltage, over a range of temperatures, and over manufacturing process variations.

One form of a reference circuit is known as a bandgap reference circuit. Bandgap reference circuits are well known in the art of analog integrated circuit (IC) design for generating a reference voltage equal to the electron bandgap level of silicon devices, which is approximately 1.2 volts. Bandgap reference circuits generally provide precise reference signals.

A conventional bandgap reference circuit utilizes bipolar transistors to provide the bandgap function. When complementary metal oxide semiconductor (CMOS) devices are implemented, the bandgap reference circuit generally utilizes parasitic bipolar transistors. A conventional bandgap circuit relies on the difference of the base-emitter junction voltages to provide a linear temperature correction voltage which is proportional to the absolute temperature (PTAT). Additionally, the base-emitter junction voltage $V_{BE}$ is proportional to the negative coefficient of temperature (i.e., the $V_{BE}$ measurement is used to track and correct changes in the reference circuit caused by temperature variations). The combination of these two effects results in the bandgap reference signal exhibiting a near-zero temperature coefficient which allows devices that utilize a bandgap reference circuit to operate with a reference signal that exhibits high accuracy.

Conventional bandgap reference circuits are known to have two stable operating states only one of which is entered when an external supply source is applied to the reference circuit during a power up condition. The first operating state corresponds to a desired operating state wherein the reference circuit supplies or generates the desired reference signal. The second operating state corresponds to an undesired state of the circuit in which the referenced circuit remains in a shutdown or inoperative condition wherein no reference signal is generated. One shortcoming of conventional bandgap reference circuits is that once the circuit enters the undesired state, the circuit tends to remain locked-up in the undesired state for an indeterminate period of time before transitioning in response to significant external stimulus, if transitioning is at all possible, to the desired operating state.

One approach for avoiding start up problems associated with bandgap reference circuits is to incorporate a start-up circuit that ensures that the bandgap reference circuit initializes to the desired operating state. One shortcoming with conventional start-up circuits is that they have been designed for responding to external source or supply voltage levels greater than approximately 1.5 volts. In many conventional electrical devices, such a supply voltage level is available and therefore sufficient such that conventional start-up circuits utilized in bandgap reference circuit designs are adequate.

However, in devices where a reduced supply voltage is preferable, generating a reference signal using conventional higher supply voltage circuits becomes difficult. Accordingly, it would be desirable to provide a reference circuit that overcomes these and other drawbacks of the prior art. More specifically, it would be desirable to provide a reference circuit that can operate at power supply voltage ranges below 1.5 volts.

BRIEF SUMMARY OF THE INVENTION

The present invention includes methods, circuits and systems for generating a reference signal for use in electronic circuits. In one embodiment of the present invention, a circuit for generating a start-up signal for a bandgap reference generator circuit is provided. The start-up circuit includes a self-biased voltage reference configured to track a supply voltage and generate a voltage independent reference signal. The circuit further includes a differential amplifier configured to generate a start-up signal to induce current flow in response to the voltage independent reference during the start-up phase of the circuit and cease inducing the current flow following the start-up phase of the circuit.

In another embodiment of the present invention, a reference generator is provided for generating a reference signal. The reference generator includes a bandgap reference circuit configured to receive a supply voltage and generate a reference signal therefrom. A start-up circuit is also provided and is configured to generate a start-up signal for inducing current flow into a node of the bandgap reference circuit during a start-up phase of the bandgap reference circuit thereby causing the bandgap reference circuit to affirmatively enter a desired operating state. The start-up circuit is further configured to cease inducing the current flow following the start-up phase of the bandgap reference circuit.

In a further embodiment of the present invention, a memory device is provided and includes a memory array and a reference generator. The reference generator includes a bandgap reference circuit configured to receive a supply voltage and generate a reference signal therefrom. The reference generator further includes a start-up circuit configured to generate a start-up signal for inducing current flow into a node of the bandgap reference circuit during a start-up phase of the bandgap reference circuit thereby causing the bandgap reference circuit to affirmatively enter a desired operating state. The start-up circuit is further configured to cease inducing the current flow following the start-up phase of the bandgap reference circuit. The memory device further includes a regulator configured to receive the reference signal and generate operational power for the memory device based on the reference signal.

In yet another embodiment of the present invention, a semiconductor wafer comprising a plurality of integrated circuit memory devices is provided. Each memory device includes a memory array and a reference generator including a bandgap reference circuit configured to receive a supply voltage and generate a reference signal therefrom. The reference generator further includes a start-up circuit configured to generate a start-up signal for inducing current flow into a node of the bandgap reference circuit during a start-up phase of the bandgap reference circuit thereby causing the bandgap reference circuit to affirmatively enter a desired operating state. The start-up circuit is further configured to cease inducing the current flow following the start-up phase of the bandgap reference circuit. The memory device further includes a regulator configured to receive the reference signal and generate operational power for the memory device based on the reference signal.

In yet a further embodiment of the present invention, an electronic system is provided and includes a processor, at least one of an input device and an output device operably coupled to the processor and a memory device. The memory device is operably coupled to the processor with the memory device including a memory array, a reference generator and a regulator. The reference generator includes a bandgap reference circuit configured to receive a supply voltage and generate a reference signal therefrom. The reference generator further includes a start-up circuit configured to generate a start-up signal for inducing current flow into a node of the bandgap reference circuit during a start-up phase of the bandgap reference circuit thereby causing the bandgap reference circuit to affirmatively enter a desired operating state. The start-up circuit is further configured to cease inducing the current flow following the start-up phase of the bandgap reference circuit and the regulator is configured to receive the reference signal and generate operational power for the memory device based on the reference signal.

In yet a further embodiment of the present invention, a method for generating a reference signal is provided. The method includes receiving a supply voltage less than a bandgap voltage in a start-up circuit and generating a start-up signal from the supply voltage in the start-up circuit. The start-up signal induces current flow into a node of a bandgap reference circuit during a start-up phase of the bandgap reference circuit. The method further includes entering a desired operating state of the bandgap reference and ceasing inducing the current flow following the start-up phase of the bandgap reference circuit.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

The various embodiments of the present invention are drawn to designs and methods for generating a reference signal of a predicable, stable and repeatable quality. The design of reference generators using digital complementary metal oxide semiconductor (CMOS) technology raises several design difficulties; namely, during reduction in component dimensions, the supply voltage becomes lower than the electron bandgap level of silicon (approximately 1.2 volts). Since bandgap reference circuits have two operational modes, namely the desirable operational state and the undesirable zero-bias state, a form of start-up circuit becomes useful to ensure that the bandgap reference circuit enters the desirable operational state when the supply voltage is applied.

Start-up circuits may include resistive dividers and/or MOS transistors; however, conventional techniques are inadequate for low-voltage operation of the reference generator and have required non-standard devices such as depletion-mode transistors. The various embodiments of the present invention utilize non-depletion mode transistors including bipolar PNP transistors and a skewed differential amplifier to provide a stable start-up circuit without requiring special low-threshold MOS devices such as depletion-mode transistors. Furthermore, standby current utilized by the start-up circuit is limited by a supply independent voltage reference. A skewed differential amplifier approach ensures that the induced current of the start-up circuit is deactivated following the reference generator's start-up phase.

Figure 1:
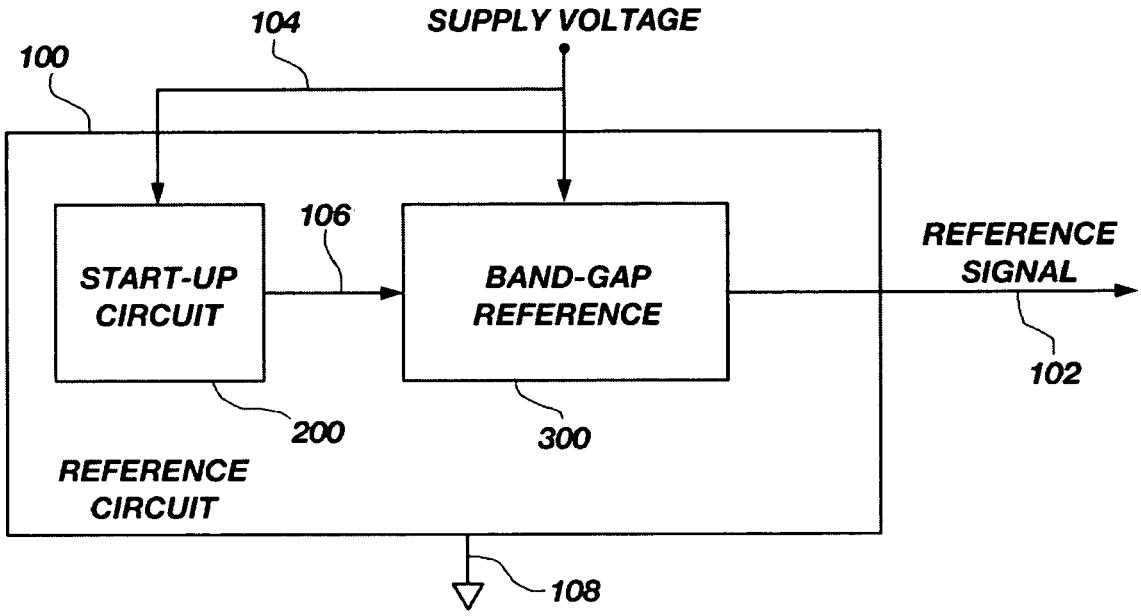
FIG. 1 is block diagram of a reference generator, in accordance with an embodiment of the present invention.

FIG. 1 is block diagram of a reference generator, in accordance with an embodiment of the present invention. A reference generator 100 operates by receiving a supply voltage 104 and generating a reference signal 102 therefrom. One objective of reference generators is to provide a reference signal that is within specific tolerances regardless of fluctuations on the supply voltage. In FIG. 1, reference generator 100 includes a bandgap reference circuit 300 for generating a stable and predictable reference signal. Bandgap reference circuit 300 is coupled between supply voltage 104 and a ground reference 108.

Accordingly, reference generator 100 further includes a start-up circuit 200 coupled between the supply voltage 104 and a ground reference 108. Start-up circuit 200 is configured to respond during the start-up phase of reference generator 100 by generating a current-inducing potential level on a start-up signal 106 which is coupled to an internal node within bandgap reference circuit 300. The signal level induces or augments current flow into the internal node on the bandgap reference circuit only during the start-up phase. The induced current into the internal node of the bandgap reference circuit 300 causes the bandgap reference circuit 300 to start-up in the desired usable reference-generating state rather than locking-up in the undesirable and unusable state.

Figure 2:
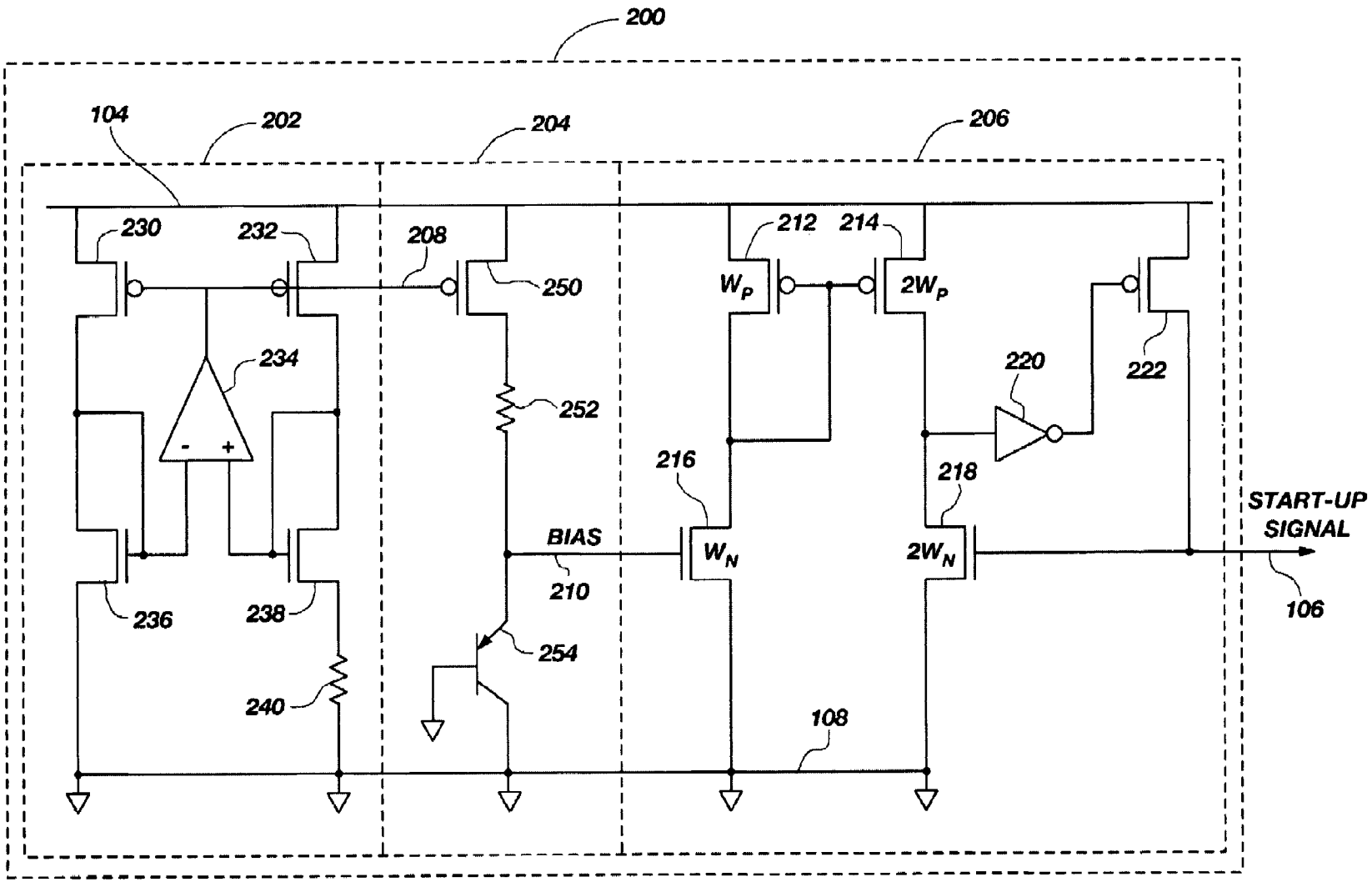
FIG. 2 is a circuit diagram of a start-up circuit for a bandgap reference circuit, in accordance with an embodiment of the present invention.

FIG. 2 is a circuit diagram of a start-up circuit for a bandgap reference circuit, in accordance with an embodiment of the present invention. Start-up circuit 200 is configured to power-up when supply voltage 104 is applied and to output start-up signal 106 during a start-up phase of the bandgap reference circuit 300 (FIG. 1). While bandgap reference circuit 300 may have various applications, one specific application includes providing reference signals on integrated circuits. As is well known, integrated circuit design is generally sensitive to both circuit area considerations with any extraneous circuitry being undesirable and to unnecessary power consumption. Therefore, in the various embodiments of the present invention, the start-up phase is time-based and determined within the start-up circuit 200 and therefore does not require additional circuitry for sensing the arrival at an operational state of the bandgap reference circuit 300.

Start-up circuit 200 includes a self-biased voltage reference 202, a bipolar reference generator 204, and a differential amplifier 206. Self-biased voltage reference 202 is configured to generate a voltage independent reference signal 208 that tracks the increasing level of supply voltage 104 during the start-up phase and continues to generate the voltage independent reference signal 208 after the supply voltage stabilizes. Self-biased voltage reference 202 includes an op amp 234 having differential inputs respectively coupled to the respective gate terminals of n-channel field effect transistors (FETs) 236, 238. The drain terminals of n-channel FETs 236, 238 are respectively coupled to drain terminals of p-channel FETs 230, 232. The gate terminals of each of the n-channel FETs 236, 238 are respectively shorted to their drain terminals. The source terminal of n-channel FET 238 is further coupled to ground reference 108 via a resistor 240. The output of op amp 234 drives the gate terminals of p-channel FETs 230, 232 and generates voltage independent reference signal 208.

Bipolar reference generator 204 includes a p-channel FET 250 with a gate terminal also driven by voltage independent reference signal 208. A drain terminal of p-channel FET 250 further couples to a collector terminal of a PNP bipolar transistor 254 via a resistor 252. A bias signal 210 is generated at the emitter terminal of the PNP bipolar transistor 254 and provides a reference input as bias signal 210 to differential amplifier 206.

Differential amplifier 206 is configured as a skewed differential amplifier with one "leg" of the differential amplifier being different in drive level from the other leg of the differential amplifier. In FIG. 2, differential amplifier 206 is configured with a first differential amplifier leg including a p-channel FET 212 coupled to an n-channel FET 216. The n-channel FET 216 is controlled at the gate terminal by bias signal 210.

Differential amplifier 206 includes a second differential amplifier leg including a p-channel FET 214 and an n-channel FET 218. The first and second differential amplifier legs are further configured in a current mirror arrangement. By way of example and not limitation, the second differential amplifier leg is illustrated as being twice the transistor channel width as the first differential amplifier leg. A drain terminal of the n-channel FET 218 of the second differential amplifier leg is further coupled to an inverter 220 which drives a p-channel FET 222 configured as a pull-up transistor coupled to the start-up signal 106 which further couples to the gate terminal ofn-channel FET 218.

In operation, the bias signal 210 during the start-up phase turns n-channel FET 216 on causing gates of both p-channel FETs 212, 214 to pull low. A high signal is driven on the input of inverter 220 causing a low signal on the output of inverter 220 which in turn causes p-channel FET 222 to pull up start-up signal 106. When start-up signal 106 is pulled up, current is induced and couples to an internal node of the bandgap reference circuit 300 (FIG. 1). The induced current causes the bandgap reference circuit 300 to start-up in a usable state as opposed to allowing the bandgap reference circuit to seek a possible unusable state. When the voltage on the start-up signal 106 reaches a level adequate to turn on the n-channel FET 218, the n-channel FET 218 pulls the input of the inverter 220 to a low level which in turn causes the output of the inverter 220 to go high and further causing the p-channel FET 222 to turn off and thereby cease from inducing further current into the internal node within the bandgap reference circuit 300. The operational level of the internal node of bandgap reference circuit 300 prevents the n-channel FET 218 from allowing the input of inverter 220 to toggle to a high level following the start-up phase of the reference generator 100 (FIG. 1).

Figure 3:
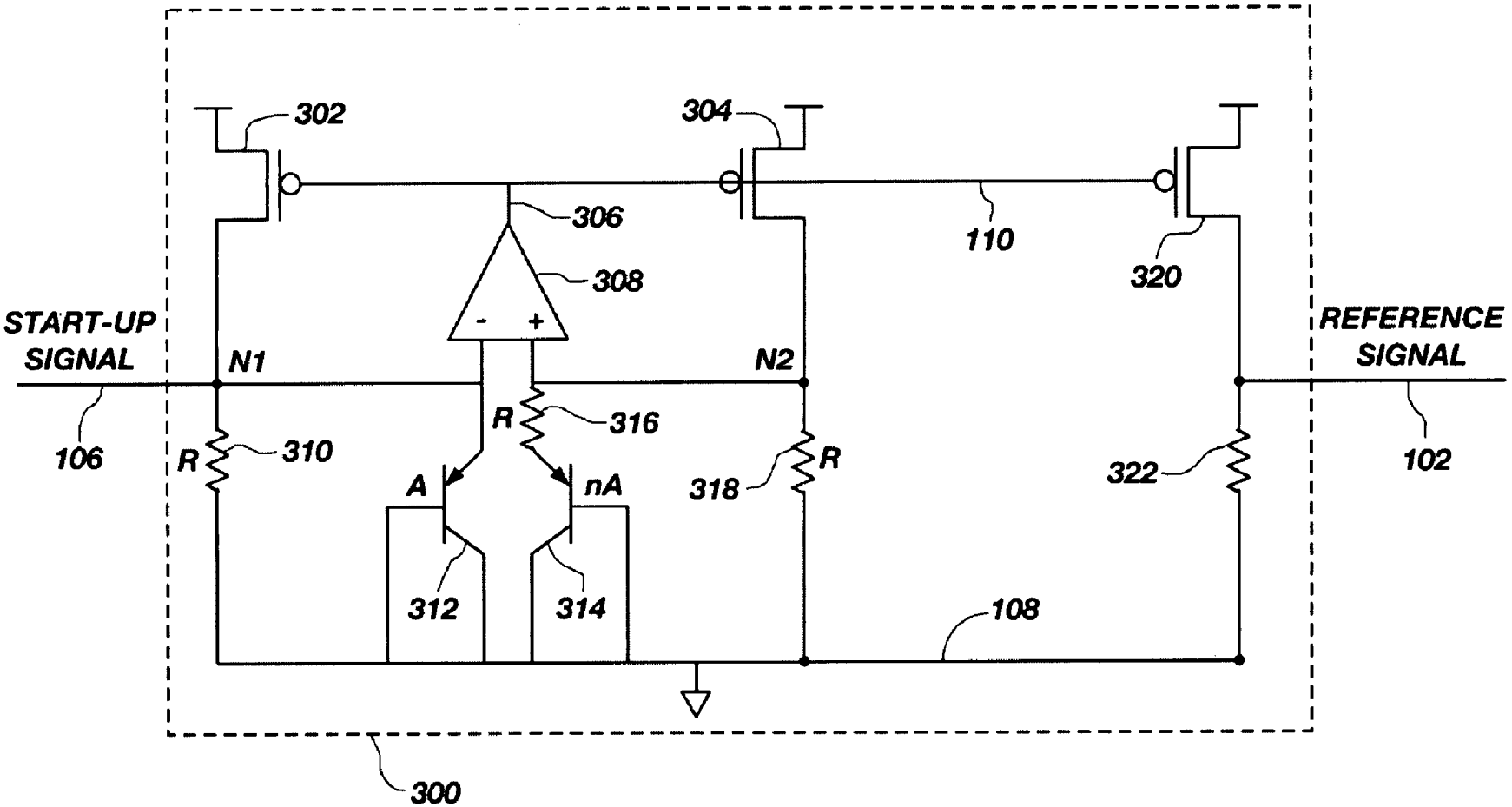
FIG. 3 is a circuit diagram of a bandgap reference circuit, in accordance with an embodiment of the present invention.

FIG. 3 is a circuit diagram of a bandgap reference circuit, in accordance with an embodiment of the present invention. A bandgap reference circuit 300 includes a pair of PNP bipolar transistors 312, 314 with the base and collectors of each transistor being connected to the ground reference 108. The emitters of PNP bipolar transistors 312, 314 are respectively connected to the drain terminals of a pair of p-channel FETs 302, 304. PNP bipolar transistor 314 is connected to the drain terminal of p-channel FET 304 via a resistor 316. PNP bipolar transistor 314 is further configured to have an emitter area that is greater than the emitter area of PNP bipolar transistor 312. An example of the emitter area ratio may be a 1-to-24 ratio where the emitter area of PNP bipolar transistor 314 is 24-times the emitter area of PNP bipolar transistor 312.

Bandgap reference circuit 300 further includes an operational amplifier 308 which functions as an error amplifier with an output generating a signal 306 for driving the gate terminals of p-channel FETs 302, 304, 320. Operational amplifier 308 further includes an inverting input connected to an internal node N1 which is further connected to the emitter of PNP bipolar transistor 312. Additionally, operational amplifier 308 includes a non-inverting input connected to node N2 which is further connected to the emitter of PNP bipolar transistor 314 via resistor 316. Operational amplifier 308 controls the gate-to-source voltage of p-channel FETs 302, 304, 320 such that the voltages at internal node N1 and node N2 are substantially equal.

Bandgap reference circuit 300 further includes a resistor 310 coupled between internal node N1 and the ground reference 108. Internal node N1 is further coupled to the start-up signal 106 as generated by start-up circuit 200 of FIG. 2. The coupling of start-up circuit 200 to bandgap reference circuit 300 via start-up signal 106 ensures that the internal node N1 does not remain at a zero-bias state which could allow the operational amplifier 308 to not properly drive signal 306 which controls p-channel FETs 302, 304, 320.

Bandgap reference circuit 300 further includes a p-channel FET 320 having a gate terminal commonly connected with the gate terminals of p-channel FETs 302, 304 and a source terminal commonly connected to the supply voltage 104 and with the source terminals of p-channel FETs 302, 304. The drain terminal of P-channel FET 320 is further connected to the ground reference 108 via a resistor 322.

Figure 4:
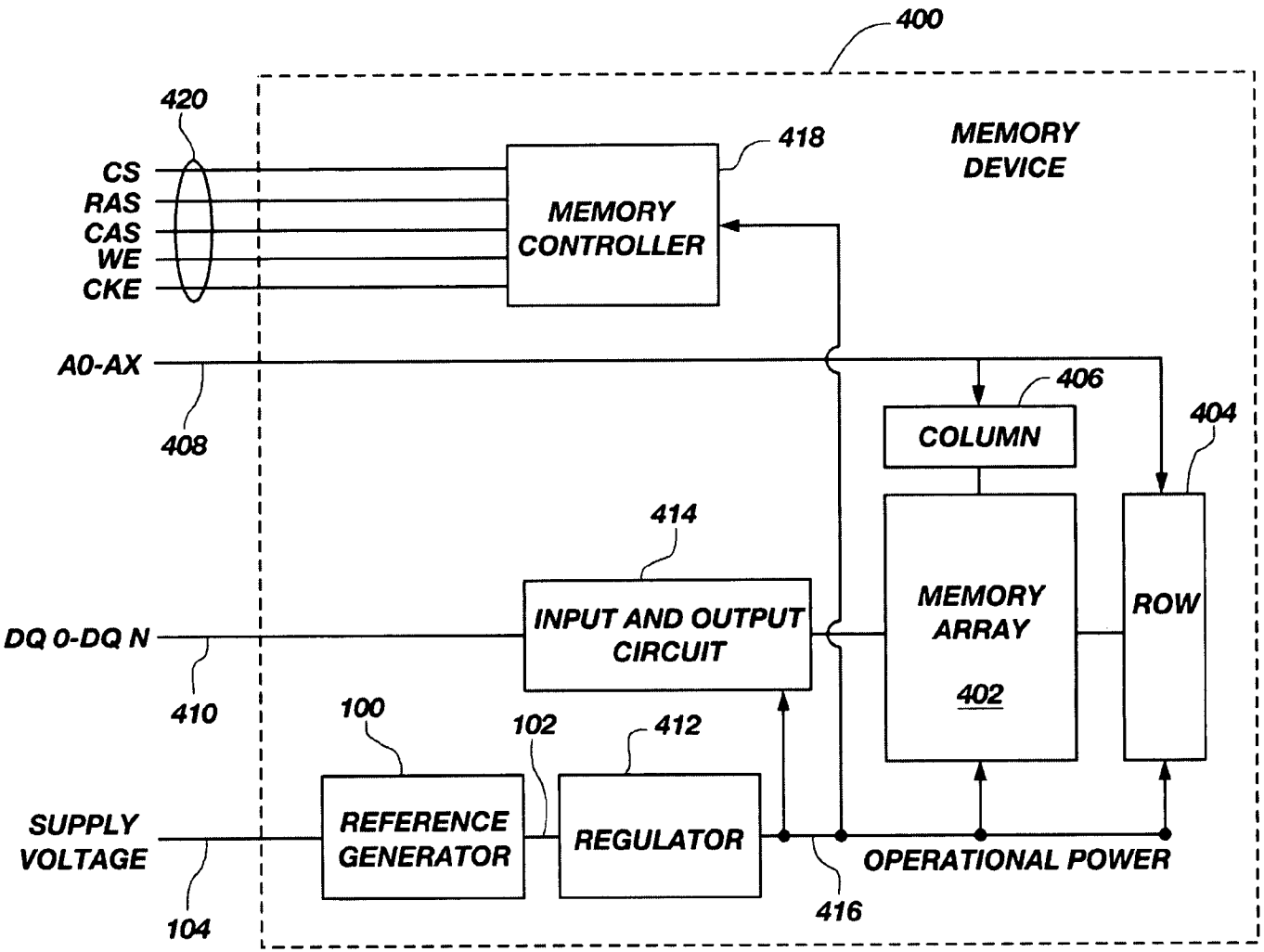
FIG. 4 is a block diagram of a memory device including a reference generator, in accordance with an embodiment of the present invention.

FIG. 4 is a block diagram of a memory device including a reference generator, in accordance with an embodiment of the present invention. A memory device 400 includes a reference generator 100 for converting a received supply voltage 104 into reference signal 102 for use by a regulator 412 in generating operational power 416 for distribution to various components on memory device 400.

Memory device 400 further includes a memory array 402 having a plurality of memory cells arranged in rows and columns. Row decode 404 and column decode 406 access the memory cells in response to address signals A0 through AX (A0-AX) on address lines (or address bus) 408. A data input/output path 410 carry data signals DQ0 through DQN between input/output circuitry 414. A memory controller 418 controls the modes of operations of memory device 400 based on control signals on control lines 420. The control signals include, but are not limited to, a Chip Select signal CS, a Row Access Strobe signal RAS, a Column Access Strobe CAS signal, a Write Enable signal WE, and a clock signal CKE. Memory device 400 further includes a regulator 412, under regulation from reference signal 102 generated by reference generator 100, to provide operational power 416 to the various other elements of memory device 400 described hereinabove.

In some embodiments of the present invention, memory device 400 may be a dynamic random access memory (DRAM) device. In other embodiments, memory device 400 may be a static random access memory (SRAM), or flash memory. Examples of DRAM devices include synchronous DRAM commonly referred to as SDRAM (synchronous dynamic random access memory), SDRAM II, SGRAM (synchronous graphics random access memory), DDR SDRAM (double data rate SDRAM), DDR II SDRAM, and Synchlink or Rambus DRAMs. Those skilled in the art recognize that memory device 400 includes other elements, which are not shown for clarity.

Figure 5:
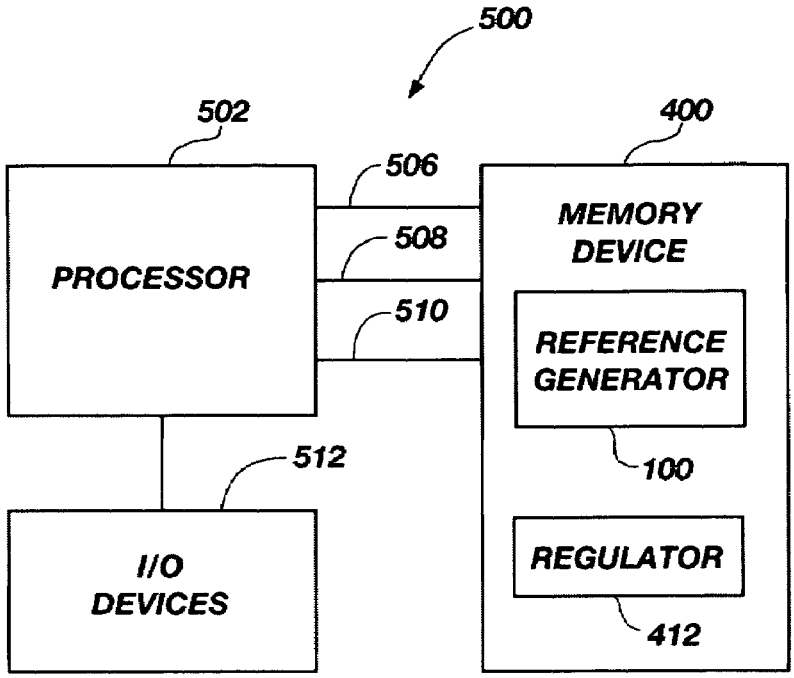
FIG. 5 is a block diagram of an electronic system including a reference generator, in accordance with an embodiment of the present invention.

FIG. 5 is a block diagram of an electronic system including a reference generator, in accordance with an embodiment of the present invention. Electronic system 500 includes a processor 502, a memory device 400, and one or more I/O devices 512. Processor 502 may be a microprocessor, digital signal processor, embedded processor, microcontroller, or the like. Processor 502 and memory device 400 communicate using address signals on lines 506, control signals on lines 508, and data signals on lines 510. Memory device 400 includes a reference generator circuit 100 and a regulator 412 for generating at least a portion of the operational power for memory device 400.

Figure 6:
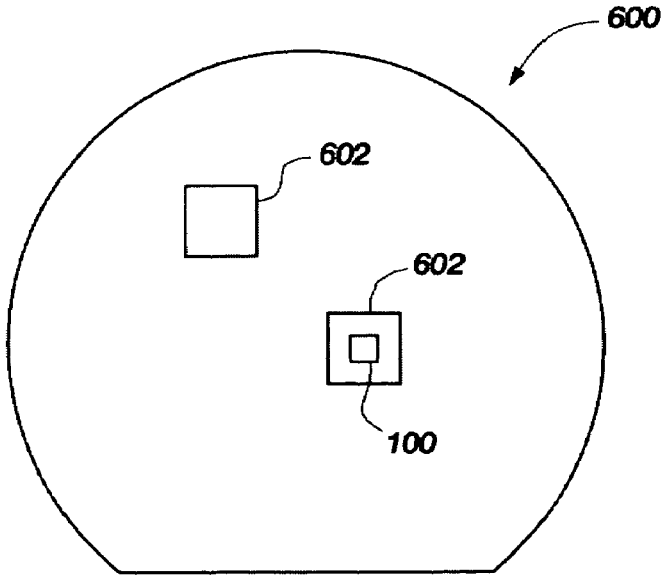
FIG. 6 illustrates a semiconductor wafer including one or more devices which further include a reference generator, in accordance with an embodiment of the present invention.

FIG. 6 illustrates a semiconductor wafer including one or more devices which further include a reference generator, in accordance with an embodiment of the present invention. A wafer 600, which includes multiple integrated circuits 602 such as a memory device 400 (FIG. 4), at least one of which incorporates a reference generator 100 (FIG. 1), in accordance with one or more embodiments of the present invention. In one embodiment, the wafer includes a semiconductor substrate, such as a silicon, germanium, gallium arsenide or indium phosphide wafer. After processing the substrate to form the various circuit elements of the reference generator, and any other circuit elements included in the integrated circuit, each integrated circuit 602 may be singulated into individual semiconductor dice, packaged, and incorporated into an electronic system.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. A start-up circuit, comprising:

a self-biased voltage reference configured to track a supply voltage and generate a voltage independent reference signal; and a differential amplifier electrically coupled to the self-biased voltage reference, the differential amplifier configured to generate a start-up signal to induce current flow in response to the voltage independent reference signal during a start-up phase of the start-up circuit and cease inducing the current flow following the start-up phase of the start-up circuit.

2. The start-up circuit of claim 1, wherein the differential amplifier is configured asymmetrically to generate the start-up signal to induce current flow during the start-up phase and cease inducing the current flow following the start-up phase of the start-up circuit.

3. The start-up circuit of claim 1, wherein the start-up circuit further comprises a bipolar reference generator configured to bias the differential amplifier in response to the voltage independent reference signal.

4. The start-up circuit of claim 3, wherein the differential amplifier includes:

a first serially connected p-channel and n-channel field effect transistors (FETs) of a first channel width wherein the n-channel FET is responsive to the voltage independent reference signal;

a second serially connected p-channel and n-channel FETs of a second channel width greater than the first channel width; and a third p-channel FET to induce the current flow during the start-up phase and cease inducing the current flow following the start-up phase of the start-up circuit.

5. The start-up circuit of claim 4, wherein the second channel width is approximately at least two-times the first channel width.

6. The start-up circuit of claim 4, wherein the n-channel and p-channel FETs are configured as non-depletion mode FETs.

7. A reference generator, comprising:

a bandgap reference circuit configured to receive a supply voltage and generate a reference signal therefrom; and a start-up circuit configured to generate a start-up signal for inducing current flow into a node of the bandgap reference circuit during a start-up phase of the bandgap reference circuit to cause the bandgap reference circuit to affirmatively enter a desired operating state, the start-up circuit further configured to cease inducing the current flow following a start-up phase of the bandgap reference circuit, wherein the start up circuit comprises:

a self-biased voltage reference configured to track the supply voltage and generate a voltage independent reference signal; and a differential amplifier configured to generate the start-up signal to induce current flow into the node of the bandgap reference circuit in response to the voltage independent reference signal during the start-up phase of the bandgap reference circuit and cease inducing the current flow following the start-up phase of the bandgap reference circuit.

8. The reference generator of claim 7, wherein the differential amplifier is configured asymmetrically to generate the start-up signal to induce current flow during the start-up phase and cease inducing the current flow following the start-up phase of the bandgap reference circuit.

9. The reference generator of claim 7, wherein the differential amplifier further comprises a bipolar reference generator configured to bias the differential amplifier in response to the voltage independent reference signal.

10. The reference generator of claim 9, wherein the differential amplifier includes:

a first serially connected p-channel and n-channel field effect transistors (FETs) of a first channel width wherein the n-channel FET is responsive to the voltage independent reference signal;

a second serially connected p-channel and n-channel FETs of a second channel width greater than the first channel width; and a third p-channel FET to induce the current flow during the start-up phase and cease inducing the current flow following the start-up phase of the bandgap reference circuit.

11. The reference generator of claim 10, wherein the second channel width is approximately at least two-times the first channel width.

12. The reference generator of claim 10, wherein the n-channel and p-channel FETs are configured as non-depletion mode FETs.

13. A method for generating a reference signal, comprising:

receiving a supply voltage in a start-up circuit;

generating a start-up signal from the supply voltage in the start-up circuit, wherein generating a start-up signal comprises:

tracking the supply voltage and generating a voltage independent reference; and generating the start-up signal in response to the voltage independent reference; and inducing current flow from the start-up signal into a node of a bandgap reference circuit during a start-up phase of the bandgap reference circuit;

entering a desired operating state of the bandgap reference circuit; and ceasing inducing the current flow following the start-up phase of the bandgap reference circuit.

14. The method of claim 13, wherein receiving a supply voltage includes receiving the supply voltage less than a bandgap voltage in the start-up circuit.

15. The method of claim 13, further comprising defining the start-up phase in the start-up circuit.

16. The method of claim 15, further comprising asymmetrically biasing a differential amplifier in the start-up circuit to generate the start-up signal during the start-up phase and cease from generating the start-up signal following the start-up phase.

* * * * *